US006134898A

United States Patent [19]

Umemura et al.

[11] Patent Number: 6,134,898

[45] Date of Patent: Oct. 24, 2000

[54] POSITIVE-DISPLACEMENT-TYPE REFRIGERANT COMPRESSOR WITH A NOVEL OIL-SEPARATING AND LUBRICATING SYSTEM

[75] Inventors: Satoshi Umemura; Shinya Yamamoto; Keishi Nakagaki, all of Kariya, Japan

[73] Assignee: Kabushiki Kaisha Toyoda Jidoshokki Seisakusho, Kariya, Japan

[21] Appl. No.: 09/345,565

[22] Filed: Jul. 8, 1999

[30] Foreign Application Priority Data

Jul. 9, 1998 [JP] Japan ..... 10-194607
Apr. 2, 1999 [JP] Japan ..... 11-096462

[51] Int. Cl.[7] ..... F25B 31/00

[52] U.S. Cl. ..... 62/193; 62/84; 62/470

[58] Field of Search ..... 62/193, 192, 470, 62/471, 473, 84

[56] References Cited

U.S. PATENT DOCUMENTS 3,200,603 8/1965 Wake et al. ..... 62/84
4,662,190 5/1987 Tischer ..... 62/470
5,345,785 9/1994 Sekigama et al. ..... 62/468

FOREIGN PATENT DOCUMENTS 55-078190 6/1980 Japan .
55-134787 10/1980 Japan .
6-249146 9/1994 Japan .
9-324758 12/1997 Japan .

*Primary Examiner*—William Doerrler
*Assistant Examiner*—Marc Norman
*Attorney, Agent, or Firm*—Woodcock Washburn Kurtz Mackiewicz & Norris LLP

[57] ABSTRACT

A capacity type refrigerant compressor having a compression chamber in which a refrigerant introduced from a suction system is compressed and discharged as a compressed high pressure refrigerant, and an oil-separating and lubricating system for lubricating an interior of the compressor by an oil separated from the compressed refrigerant, which has an oil-separating unit to separate the oil from the compressed refrigerant, an oil-storing chamber storing the separated oil, an oil-supply passage to supply the oil from the oil-storing chamber to the suction system, a pressure-operated valve arranged in the oil supply passage to regulate an amount of flow of the oil, which includes a valve chamber and a movable valve spool in the valve chamber to control a communication between the upstream and downstream of the oil-supply passage. The valve spool element moves in response to a change in a pressure differential between pressures in the compression chamber and the suction system, and blocks the oil flow in the oil-supply passage when the pressure differential is overcome by a spring force arranged in the valve chamber.

8 Claims, 4 Drawing Sheets

POSITIVE-DISPLACEMENT-TYPE REFRIGERANT COMPRESSOR WITH A NOVEL OIL-SEPARATING AND LUBRICATING SYSTEM

BACKGROUND OF THE INVENTION

1. Field of the Invention

The present invention generally relates to positive-displacement-type refrigerant compressors including reciprocating type refrigerant compressors and rotary type refrigerant compressors. More particularly, the present invention relates to an oil-separating and lubricating system incorporated in a positive-displacement-type refrigerant compressor for the lubrication of various internal portions and movable elements of the positive-displacement-type refrigerant compressor by separating oil from a refrigerant at a high pressure and by supplying the separated oil to the portions and elements to be lubricated.

2. Description of the Related Art

In a positive-displacement-type refrigerant compressor mainly incorporated in a vehicle climate control system, lubrication of various internal portions and movable elements of the compressor is achieved by an oil, i.e., an oil mist suspended in a gas-phase refrigerant which is compressed within the compressor. Therefore, when the compressed refrigerant containing and suspending therein the oil is delivered from the compressor to an external refrigerating system in the climate control system, the oil is attached to an internal wall of an evaporator of the refrigerating system to result in a reduction in the heat exchanging efficiency of the evaporator. Thus, in the conventional refrigerating system, an oil separating unit is arranged in a high pressure gas pipe extending from the refrigerant outlet of the compressor to a condenser, and the separated oil is returned from the oil separating unit into the interior of the refrigerant compressor via a separate oil-return conduit. However, an arrangement of the oil separating unit in the gas pipe and an addition of the oil-return conduit to the refrigerating system make it cumbersome to assemble the refrigerating system of the vehicle climate control in the rather narrow assembling space in a vehicle. Further, the oil-return conduit is usually formed by a long pipe element having a small diameter, and accordingly, clogging easily occurs during the operation of the compressor. Therefore, a refrigerant compressor has been provided which is provided with an oil-separating unit directly incorporated therein.

The oil-separating unit incorporated in the conventional refrigerant compressor is provided with an oil storing chamber formed in the compressor for storing an oil separated from a refrigerant in a high pressure region within the compressor, and an oil-return passage communicating the oil storing chamber with a low pressure region such as a crank chamber in the compressor for supplying the oil from the oil storing chamber to the low pressure region. The oil-return passage is provided with a valve unit arranged therein to control an amount of oil to be supplied into the low-pressure region in response to a change in the operating condition of the compressor.

For example, Japanese Unexamined Patent Publication (Kokai) No. 9-324758 (JP-A-9-324758) discloses a valve unit which functions to interrupt the oil-return passage during the running of the compressor, and to permit the oil to flow therethrough when the operation of the compressor is stopped.

Japanese Unexamined Patent Publication (Kokai) No. 6-249146 (JP-A-6-249146) discloses a valve unit used in a variable displacement type refrigerant compressor and operates in such a manner that when an oil separating chamber is kept at a high pressure during a large displacement operation of the compressor, a restricted amount of oil is permitted to pass through an oil-return passage via the valve unit, and when the oil separating chamber is kept at a low pressure during a small displacement operation of the compressor, a large amount of oil is permitted to pass through the oil-return passage via the valve unit.

Nevertheless, in the two conventional incorporated type oil separating systems of JP-A-9-324758 and JP-A-6-249146, no positive means to completely prevent the oil from being delivered from the interior of the compressor into an associated refrigerating system is provided. Namely, since the lubrication of various internal portions and movable elements of the refrigerant compressor must rely on mainly the oil suspended in the refrigerant returned from an external refrigerating system, at least when the refrigerant compressor is stopped, an amount of the oil supplied to the low pressure region in the compressor must be increased to prevent lack of lubricant at the start of operation of the refrigerant compressor. In this connection, even if the amount of oil delivered from the refrigerant compressor is small, delivery of the oil from the compressor into the external refrigerating system results in preventing an increase in the heat exchanging efficiency in the refrigerating system depending on the amount of oil in a unit weight of refrigerant.

Moreover, when the compressor is stopped, and if a large amount of oil is supplied to the low pressure region in the compressor, the oil remaining in the low pressure region is suddenly agitated due to the restarting of the compressor, and will cause the splashing of the oil. Accordingly, compression of the oil, i.e., a liquid or oil compression occurs within the respective cylinder bores. Thus, an unpleasantly strong shock and a noise are generated in the interior of the refrigerant compressor.

SUMMARY OF THE INVENTION

Therefore, an object of the present invention is to obviate all defects encountered by the conventional oil separating and lubricating unit incorporated in a refrigerant compressor.

Another object of the present invention is to provide a positive-displacement-type refrigerant compressor internally provided with a novel oil-separating and lubricating system able to achieve both lubrication of the interior of the compressor and an enhancement of heat exchanging efficiency in a refrigerating system in which the compressor is incorporated.

A further object of the present invention is to provide a positive-displacement-type refrigerant compressor internally provided with an oil-separating and lubricating system having function to prevent occurrence of the oil compression even when the compressor is started.

In accordance with the present invention, there is provided a positive-displacement-type refrigerant compressor including:

- a suction system to receive a refrigerant at a suction pressure from an external refrigerating system,
- a compressing mechanism having a compression chamber in which the refrigerant introduced from the suction system is compressed to discharge the refrigerant after compression into a discharge chamber, and
- an oil-separating and lubricating system for lubricating the interior of the positive-displacement-type refrigerant compressor by oil separated from the refrigerant, wherein the oil-separating and lubricating system comprises:

an oil-separating unit accommodated in a high pressure region communicating with the discharge chamber to cause separation of the oil from the refrigerant after compression;

an oil-storing chamber accommodated in the high pressure region to store the oil separated by the oil-separating unit;

an oil-supply passage supplying the oil from the oil storing chamber to the suction system;

a pressure-operated valve disposed in the oil-supply passage for regulating an amount of flow of the oil from the oil-storing chamber to the suction system in response to a change in a pressure differential between pressures prevailing in both the compression chamber and the suction system, the pressure-operated valve closing the oil-supply passage at a predetermined portion thereof when the compression mechanism stops its operation to compress the refrigerant.

Preferably, the pressure-operated valve includes:

a valve chamber having opposite ends, one being fluidly communicating with the compression chamber and the other being fluidly communicating with the suction system, the valve chamber further having an inner wall provided with a first port constantly communicating with an upstream side of the oil-supply passage and a second port constantly communicating with a downstream side of the oil-supply passage;

a valve spool element arranged in the valve chamber to be movable between the opposite ends of the valve chamber, the valve spool element having opposite pressure receiving ends for receiving the pressure from the compression chamber and that from the suction system, and an outer circumference extending between the opposite pressure receiving ends for defining a gap-like oil passage enclosed by the inner wall of the valve chamber and by a pair of sealing elements fitted around two spaced predetermined positions of the outer circumference of the valve spool element, the gap-like oil passage being arranged to provide a fluid communication between the upstream and downstream sides of the oil-supply passage;

an elastic element disposed in the valve chamber at the above-described other of the opposite ends thereof to exhibit a spring force constantly urging the valve spool towards the above-described one of the opposite ends of the valve chamber, so that when the pressure differential of the pressures from both the compression chamber and the suction system is overcome by the spring force of the elastic element, the spool element is moved toward the one of the opposite ends of the valve chamber until the fluid communication between the upstream and downstream sides of the oil-supply passage is obstructed by the valve spool element.

Further preferably, the oil-separating and lubricating system is provided with a flow restriction in a portion of the oil-supply passage.

When the compressing mechanism of the positive-displacement-type refrigerant compressor employs reciprocating pistons to compress the refrigerant, the pressure introduced from the compression chamber into the above-described one of the opposite ends of the valve chamber and acting on the valve spool element can be maintained at a substantially average of the pressures prevailing in the compression chamber by provision of a restriction function in a pressure introducing passage.

On the other hand, when a positive-displacement-type refrigerant compressor is a rotary type refrigerant compressor, the pressure introduced from the compression chamber into the above-described one of the opposite ends of the valve chamber and acting on the valve spool element can be an intermediate value of the pressures prevailing in the compression chamber.

BRIEF DESCRIPTION OF THE DRAWINGS

The above and other objects, features, and advantages of the present invention will be made more apparent from the ensuing description of the preferred embodiments thereof with reference to the accompanying drawings wherein.

DESCRIPTION OF THE PREFERRED EMBODIMENTS

Figure 1:
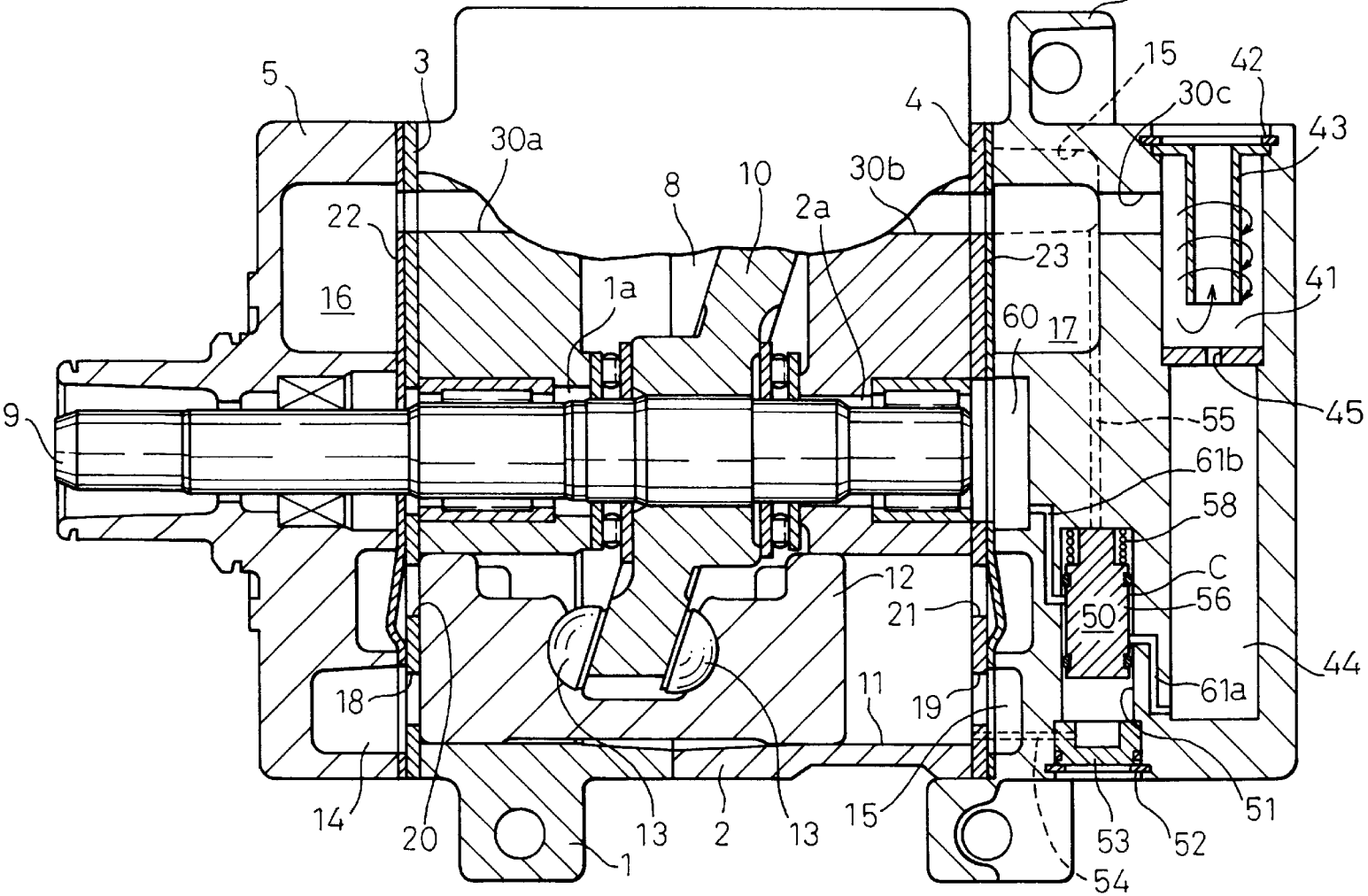
FIG. 1 is a longitudinal cross-sectional view of a positive-displacement-type refrigerant compressor, i.e., a swash plate operated double-headed piston type refrigerant compressor with an oil-separating and lubricating system, according to an embodiment of the present invention.

Referring to FIG. 1, a double-headed-piston-incorporated reciprocating-type refrigerant compressor is provided with a pair of axially combined cylinder blocks 1 and 2 having later-described five cylinder bores on axially left and right sides of the combined cylinder blocks. The combined cylinder blocks 1 and 2 have axially front and rear ends closed by a front housing 5 and a rear housing 6, via a front valve plate 3 and a rear valve plate 4, respectively. The front housing 5, the front cylinder block 1, the rear cylinder block 2 and the rear housing 6 are gas-tightly combined together by several long screw bolts (not shown in FIG. 1). The connecting portion of the combined front and rear cylinder blocks 1 and 2 is provided with a crank chamber 8 formed therein to receive a swash plate (a cam plate) 10 fixedly mounted on a drive shaft 9 which is rotatably supported by the combined cylinder blocks 1 and 2, and axially extends through a central bores 1*a* and 2*a* of the combined cylinder blocks 1 and 2. The swash plate 10 is thus rotated together with the drive shaft 9 about an axis of rotation of the drive shaft 9.

The axially aligned five cylinder bores 11 on the left and right sides of the combined cylinder blocks 1 and 2 are arranged in parallel with one another with respect to and circumferentially spaced apart from one another around the axis of rotation of the drive shaft 9.

Double-headed pistons 12 are slidably fitted in the cylinder bores 11 on the axially left and right sides of the cylinder blocks 1 and 2, each of the double-headed pistons 12 is engaged with the swash plate 10 via a pair of semispherical shoes 13, 13.

The front and rear housings 5 and 6 are internally provided with suction chambers 14 and 15 formed in a radially outer region of the interior of the respective housings 5 and 6, and discharge chambers 16 and 17 formed in a radially inner region of the interior of the front and rear housings 5 and 6. The front and rear valve plates 3 and 4 are provided with suction ports 18, 19 formed therein to permit the refrigerant to be sucked from the respective suction chambers 14 and 15 into the respective cylinder bores 11 on the left and right sides. The front and rear valve plates 3 and 4 are also provided with discharge ports 20, 21 formed therein to permit the high pressure refrigerant after compression to be discharged from the respective cylinder bores 11 on the left and right sides into the discharge chambers 16 and 17. Suction valves (not shown) are arranged at the respective boundaries between the front and rear ends of the combined cylinder blocks 1 and 2 and the front and rear valve plates 3 and 4 to openably close the suction ports 18, 19, and discharge valves (not shown) are arranged at respective boundaries between the front and rear valve plates 3 and 4 and the front and rear housings 5 and 6 to openably close the discharge ports 20 and 21 and to be supported by valve retainers 22 and 23.

As best shown in FIG. 1, the discharge chambers 16 and 17 of the front and rear housings 1 and 2 are provided with partially radially extending portions therein, which are fluidly connected to one another by discharge passages 30*a* and 30*b* formed in the combined cylinder blocks 1 and 2, and are fluidly connected to a delivery passage 30*c* formed in the rear housing 6, and the delivery passage 30*c* is fluidly connected to an outlet port (not shown in FIG. 1) for delivering the compressed refrigerant into an external refrigerating system via an oil-separating mechanism which is also formed in the rear housing 6.

The above-mentioned oil-separating mechanism constitutes a part of an oil-separating and lubricating system, and the oil-separating mechanism includes an oil-separating chamber 41 formed as a cylindrical bore formed in the rear housing 6 to have an inner bottom. The oil-separating chamber 41 fluidly communicates with the above-mentioned delivery passage 30*c* and receives therein a flanged oil-separating cylinder 43 which is attached to an uppermost position of the oil-separating chamber 41 by means of a snap ring 42. An oil-storing chamber 44 is arranged below the oil-separating chamber 41 for receiving an oil from the chamber 41. The oil-storing chamber 44 is formed to have a volume sufficient to store all of the oil which is preliminarily filled into the interior of the compressor during the assembly of the compressor, and for surely circulating all of the filled oil through various pressure regions in the interior of the compressor for the purpose of lubricating many portions such as cylinder bores 11 and opposite faces of the swash plate 10, and movable elements of the compressor such as double-headed pistons 12, shoes 13, and various radial and thrust bearings. The fluid communication between the oil-separating chamber 41 and the oil-storing chamber 44 is provided by an oil hole 45 formed in the bottom of the oil-separating chamber 41.

Figure 2:
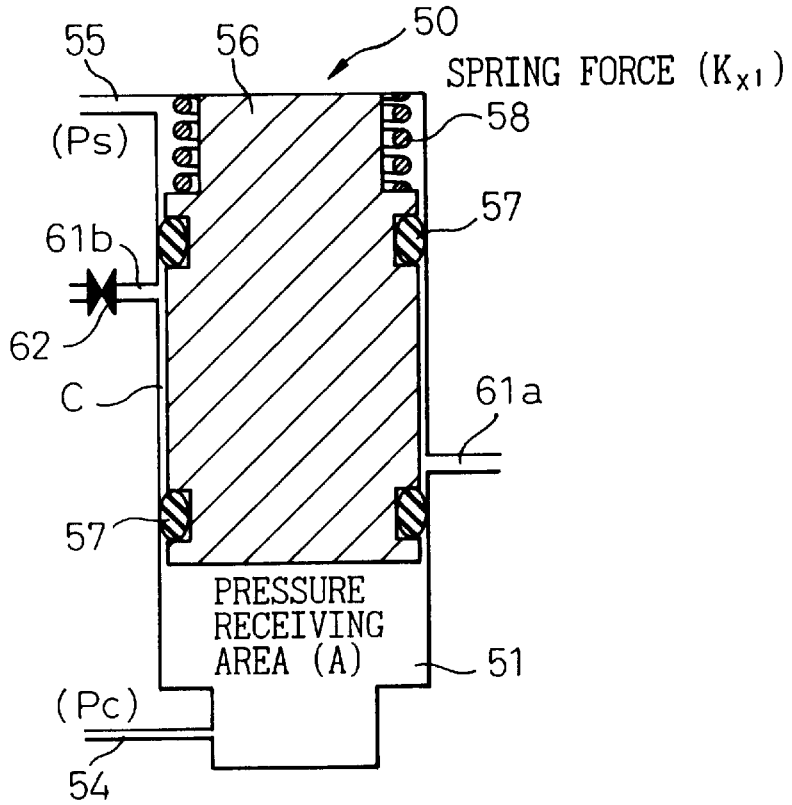
FIG. 2 is an enlarged cross-sectional view of a valve assembly adapted for use in the oil-separating and lubricating system of the compressor of FIG. 1, illustrating a state where a valve port is opened.
Figure 3:
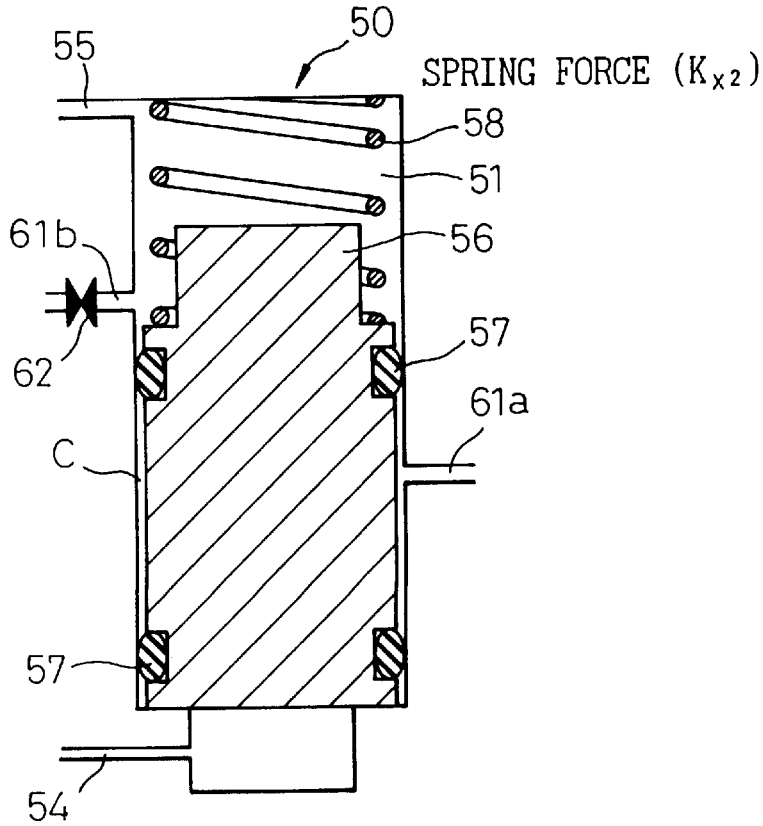
FIG. 3 is a similar view to FIG. 2, illustrating a state where the valve port is closed by a valve element.

Referring to FIGS. 2 and 3 in addition to FIG. 1, the oil-separating and lubricating system is further provided with a pressure-operated valve 50 formed as a differential pressure type valve and received in a bottomed bore formed in the rear housing 6 as a valve chamber 51.

An opening of the valve chamber 51 is sealingly closed by a lid 53 which is fixedly seated in position in the rear housing 6 by means of a snap ring 52. The closed valve chamber 51 of the pressure-operated valve 50 is provided with opposite ends (upper and lower ends in FIGS. 1 through 3) spaced apart longitudinally from one another. One end, i.e., the lower end of the valve chamber 51 is fluidly connected to one of the cylinder bores 11 (one compression chamber) via a pressure-introducing passage 54 which is narrowed so as to have the function of flow restriction. The other end, i.e., the upper end of the valve chamber 51 is fluidly connected to the suction chamber 15 in the rear housing 6 via a pressure-sensing passage 55.

A valve spool 56 in the shape of a cylindrical element is received in the valve chamber 51 to be movable in a longitudinal direction. The valve spool 56 has opposite flat ends and an outer circumference in which two longitudinally spaced annular grooves are formed to receive sealing elements (e.g., o-rings) 57, 57. An intermediate portion of the outer circumference of the valve spool 56 extending between the two sealing elements 57, 57 defines a cylindrical small gap "C" enclosed by an inner cylindrical wall of the valve chamber 51. The small gap "C" is provided as a part of an oil passage through which an oil can flow from the afore-mentioned oil-storing chamber 44 into the valve chamber 51. A spring element 58, typically a coil spring, is disposed in the valve chamber 51 at the upper end thereof. One end of the spring element 58 bears against the upper end of the valve chamber 51 and the other end of the spring element 58 is seated against a shoulder formed in an upper portion of the valve spool 56. Thus, the spring element 58 constantly urges the valve spool 56 from the upper end of the valve chamber 51 communicating with the suction chamber 15 toward the lower end of the valve chamber 51 communicating with the compression chamber 11. A pressure coming from the suction chamber 15 via the pressure-sensing passage 55, i.e., a suction pressure of the refrigerant also contributes to the urging of the valve spool 56 toward the lower end of the valve chamber 51.

The rear housing 6 is provided with a counter-bore 60 centrally formed therein, which fluidly communicates with the crank chamber 8 via the central bore 2*a* of the combined cylinder blocks 1 and 2. The rear housing 6 is further provided with an oil passage 61*a* extending between the oil-storing chamber 44 and the valve chamber 51 of the pressure-operated valve 50, and an additional oil passage 61*b* extending between the valve chamber 51 and the above-mentioned counter-bore 60. Thus, the counter-bore 60 is fluidly communicated with the oil-storing chamber 44 through the oil passages 61*a* and 61*b* and the pressure-operated valve 50, so that the oil stored in the oil-storing chamber 44 can be supplied to the counter-bore 60, and additionally to the central bore 2*a* and the crank chamber 8 when the valve spool 56 is moved toward the upper end of the valve chamber 51 as shown best in FIG. 2. It will be understood that the oil passages 61*a* and 61*b* are provided as upstream side and downstream side oil-supplying passages, respectively, so that a circulating oil lubrication passageway is formed by which the oil to lubricate the interior of the compressor is basically circulated through the oil-storing chamber 44, the upstream side oil passage 61*a*, the cylindrical small gap "C" around the valve spool 56, the downstream side oil passage 61*b*, the counter-bore 60, the central bore 2*a*, the crank chamber 8, the discharge chambers 16, 17, and the oil-separating chamber 41.

However, it should be understood that when the valve spool 56 is moved to the lowermost end of the valve chamber 51 as best shown in FIG. 3 due to a change in a differential pressure between pressures acting on the pressure-receiving areas formed in the opposite ends of the valve spool 56, the small gap "C" around the valve spool 56 is fluidly disconnected from the oil passage 61*b*, i.e., the downstream side of the oil-supply passage. More specifically, a port of the valve chamber 51 where the oil passage 61*b* is connected to the interior of the valve chamber 51 is positioned so that the port is fluidly disconnected from the small gap "C" of the valve spool 56 when the valve spool is moved to the lowermost end of the valve chamber 51. As a result, the fluid communication between the upstream and downstream sides of the oil-supply passage is interrupted by the pressure-operated valve 50.

In a preferred embodiment, a flow restriction 62 is arranged in the oil passage 61*b* for restricting an amount of flow of the oil from the oil-storing chamber 44 into the crank chamber 8 constituting a part of the suction system of the compressor, via the small gap "C" of the pressure-operated valve 50. The flow restriction 62 may be arranged in the oil passage 61*a* as required.

When the positive-displacement-type refrigerant compressor incorporating therein the oil-separating and lubricating system of FIGS. 2 and 3 is driven by an application of a drive power from an external drive source, i.e., a vehicle engine to the drive shaft 9, the drive shaft 9 is rotated together with the swash plate 10 and therefore, the double-headed pistons 12 engaged with the swash plate 10 are reciprocated in the corresponding cylinder bores 11. Thus, the refrigerant is sucked from the suction chambers 14, 15 into the cylinder bores 11 and compressed by the pistons 12. The compressed refrigerant is discharged by the pistons 12 from the compression chambers within the cylinder bore 11 toward the discharge chambers 16, 17. When the compressed refrigerant is discharged into the discharge chambers 16, 17, it is further introduced into the oil separating chamber 41 via the discharge passages 30*a* and 30*b* and the delivery passage 30*c*. When the compressed refrigerant is introduced from the delivery passage 30*c* into the oil-separating chamber 41, the compressed refrigerant is forcedly rotated around the oil-separating cylinder 43 by the cylindrical inner wall of the oil-separating chamber 41, as shown by arrows in FIG. 1, and is introduced into the interior of the flanged oil-separating cylinder 43 via an opening thereof. The compressed refrigerant is further delivered from the interior of the oil-separating cylinder 43 toward an external refrigerating system via a delivery port (not shown in FIG. 1) of the compressor.

During the rotary movement of the compressed refrigerant in the oil-separating chamber 41, the oil component suspended in the compressed refrigerant is effectively separated from the refrigerant due to a centrifugal force acting on the oil component, and the separated oil flows down to the bottom of the oil-separating chamber 41 and, further, into the oil-storing chamber 44 via the oil hole 45. At this stage, it should be understood that due to the oil separation from the refrigerant in the oil-separating chamber 41, a refrigerant containing less oil component therein is delivered from the delivery port of the compressor into the external refrigerating system. Namely, the amount of oil contained in a unit weight of refrigerant is reduced within the oil-separating chamber 41 before the compressed refrigerant gas is delivered from the delivery port. Thus, the compressed refrigerant containing less amount of oil component can be effectively used as a heat-exchange-medium in the refrigerating system.

Further, when the oil separation is conducted by the oil-separating mechanism within the oil-separating chamber 41, pulsations in the pressure of the compressed refrigerant can be physically suppressed. Thus, a compressed refrigerant under a relatively stable pressure can be delivered from the compressor to the external refrigerating system, so that any adverse affect such as vibration and noise is not provided to the refrigerating system.

During the operation of the refrigerant compressor, a very high pressure "Pc" reaches one end, i.e., the lower end of the valve chamber 51 of the pressure-operated valve 50 through the pressure-introducing passage 54 which extends between the predetermined one of the cylinder bores 11 and the lower end of the valve chamber 51. Further, a suction pressure "Ps" prevails in the other end, i.e., the upper end of the valve chamber 51. Nevertheless, since the pressure "Pc" is far higher than the pressure "Ps", and since a pressure differential between the pressures "Pc" and "Ps" is sufficient for overcoming the spring force "Kx" of the spring element 58, the valve spool 56 is moved toward and held at the upper end of the valve chamber 51 as shown in FIG. 2. Accordingly, the upstream and downstream oil passages 61*a* and 61*b* are fluidly connected to one another via the oil passage (the small gap) "C" of the pressure-operated valve 50. At this stage, the pressure "Pc" introduced from one of the cylinder bores 11 into the lower end of the valve chamber 51 is constantly maintained at a fully leveled pressure intermediate between the peak discharge pressure and the suction pressure within the cylinder bore 11, due to the flow restriction effect of the narrow pressure-introducing passage 54.

When the upstream and downstream oil passages 61*a* and 61*b* are connected to one another via the pressure-operated valve 51, the oil stored in the oil-storing chamber 44 flows through the oil passages 61*a*, "C", and 61*b* into the counter-bore 60 in the rear housing 6, and the amount of flow of the oil is restricted and kept constant by the flow restriction 62 in the downstream side oil passage 61*b*. The oil further flows from the counter-bore 60 into the crank chamber 8 via the central bore 2*a* of the rear cylinder block 2 to lubricate many inner portions of the compressor such as the cylinder bores 11, and the movable elements such as the double-headed pistons 12, various bearings, the swash plate 10 and, the shoes 13 and is eventually mixed with the refrigerant within the suction pressure region. Thus, during the operation of the compressor, the controlled amount of oil component is constantly circulated through the oil-storing chamber 44, the crank chamber 8, and the oil-separating chamber 41 while lubricating the interior of the compressor.

It should be understood that the pressure-operated valve 50 is designed and produced so as to satisfy an inequality as set forth below.

$$K_{X1}<\{(Pc-Ps)\times A\}-f$$

Where $K_{X1}$ indicates the spring force exhibited by the spring element 58 when it is contracted as shown in FIG. 2, "A" indicates the pressure receiving area of the lower end of the valve spool 56, and "f", indicates a static friction force exhibited by the seal element 57.

When the operation of the refrigerant compressor is stopped, the pressure Pc prevailing in the lower end of the valve chamber 51 of the pressure-operated valve 50 through the pressure-introducing passage 54 is quickly reduced to a pressure level substantially equal to the suction pressure Ps of the compressor and, accordingly, a differential pressure between the pressures Pc and Ps is overcome by the spring force $K_X$ of the spring element 58, and accordingly, the valve spool 56 is moved to the lowermost end of the valve chamber 51 as shown in FIG. 3. As a result, the oil Passage (the small gap) "C" is fluidly disconnected from the downstream side oil passage 61*b*, and therefore, the downstream side oil passage 61*b* is disconnected from the upstream side oil passage 61*a*. Therefore, the circulation of the oil through the oil-storing chamber 44, the crank chamber 8 and, the oil-separating chamber 41 is stopped in response to the stopping of the operation of the positive-displacement-type refrigerant compressor. Accordingly, the supply of oil to the crank chamber 8 is automatically stopped to prevent an excessive amount of oil from remaining in the crank chamber 8. Therefore, when the operation of the refrigerant compressor is again started, oil-compression within the cylinder bores 11 does not occur. Moreover, as soon as the operation of the refrigerant compressor is started, the circulation of the oil from the oil-storing chamber 44 to the oil-separating chamber 41 through the crank chamber 8 is quickly started by the movement of the valve spool 56 from the position shown in FIG. 3 to that shown in FIG. 2 to lubricate the interior of the compressor. It should be understood that, when the valve spool 56 is moved to the position shown in FIG. 3, the following inequality is established with regard to the pressure-operated valve 50.

$$K_{X2}>\{(Pc-Ps)\times A\}+f$$

Where $K_{X2}$ indicates a spring force exhibited by the spring element 58 extended to the condition shown in FIG. 3.

Figure 4:
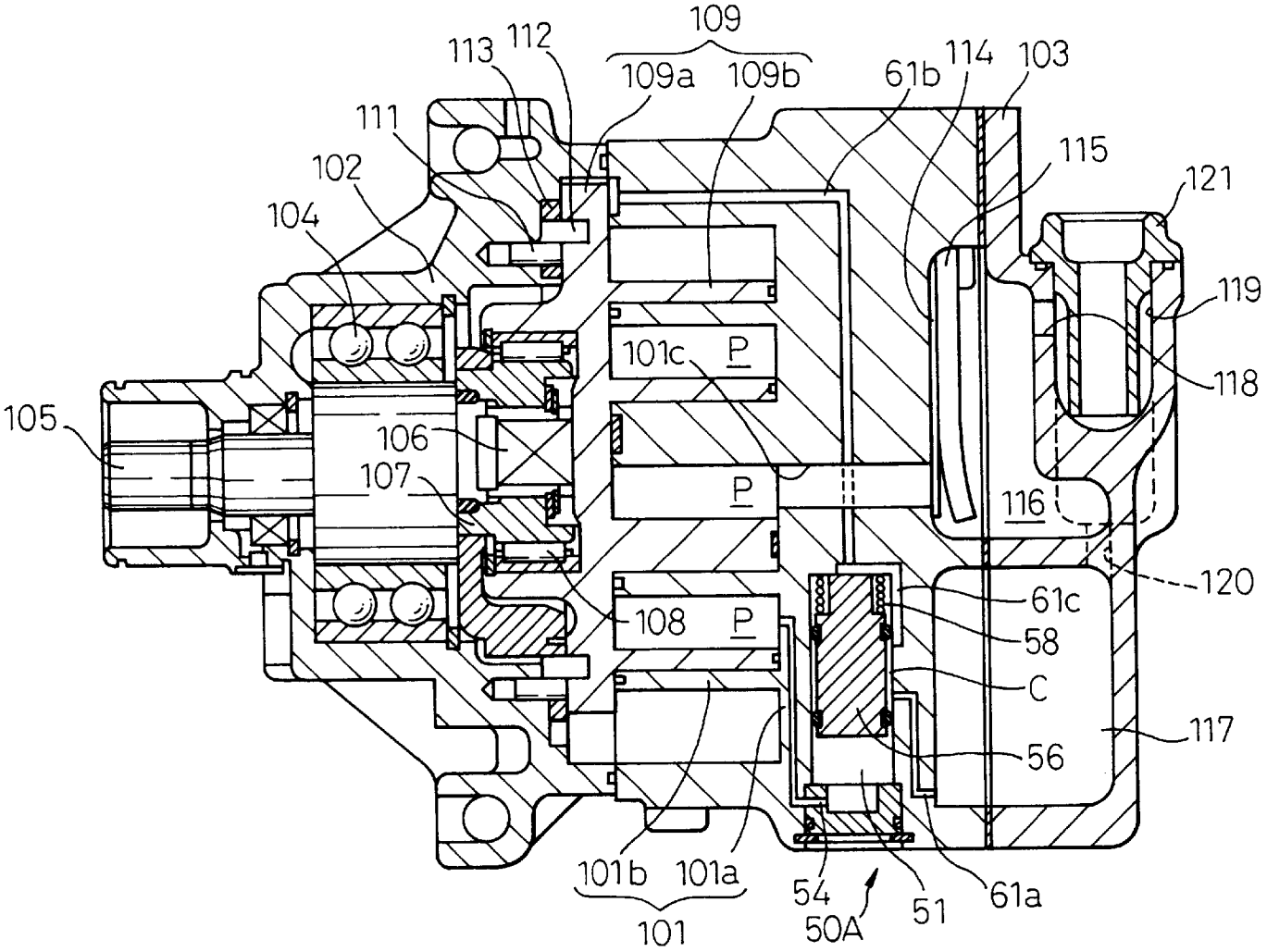
FIG. 4 is a cross-sectional view of a scroll type refrigerant compressor, i.e., a typical rotary type refrigerant compressor, provided with an oil-separating and lubricating system therein, according to the present invention.

FIG. 4 is a longitudinal cross-sectional view of a scroll type refrigerant compressor, a typical rotary type refrigerant compressor, to which the present invention is applied.

The scroll type refrigerant compressor of FIG. 4 includes a fixed scroll element 101 formed to be integral with a shell element forming an outer framework of the compressor, and front and rear housings 102 and 103 sealingly attached to opposite ends of the fixed scroll element 101. The fixed scroll element 101 is provided with a fixed side plate 101*a* and a fixed spiral member 101*b* integrally attached to the fixed side plate 101*a*. The front housing 102 supports therein a drive shaft 105 to be rotatable about an axis of rotation thereof via a radial bearing 104. The drive shaft 105 has an outer end connectable to an external drive source, and an inner end having a slide key member 106 arranged to be eccentric with the axis of rotation of the drive shaft 105 and projecting axially. The slide key member 106 holds thereon a drive bush 107 so that the drive bush 107 is permitted to radially slide with respect to the slide key member 106.

The scroll type refrigerant compressor further includes a movable scroll element 109, which is held on the drive bush 107 via a radial bearing 108. The movable scroll element 109 is provided with a movable side plate 109*a*, and a movable spiral member 109*b* integrally attached to an inner face of the movable side plate 109*a*. The movable scroll element 109 having the movable side plate 109*a* and the spiral member 109*b* is engaged with the fixed scroll element 101 having the fixed side plate 101*a* and the fixed spiral member 101*b* to define a plurality of compression chambers P therebetween.

The front housing 102 is further provided with a plurality of pins 111 fixed thereto. Similarly, the movable side plate 109*a* of the movable scroll element 109 is provided with a plurality of pins 112 fixed thereto. The pins 111 of the front housing 102 and the pins 112 of the movable scroll element 109 are engaged in a ring-like retainers 113, respectively, which are slidably seated in a recess counter-bored in the inner face of the front housing 102, to prevent the movable scroll element 109 from self-rotating.

The fixed side plate 101*a* of the fixed scroll element 101 is centrally provided with a discharge passage 101*c* bored therein and having an outer open end closed by a reed type discharge valve 114 which is permitted to open until it comes into contact with a valve retainer 115.

A discharge chamber 106 is formed in both the fixed scroll element 101 and the rear housing 103 for receiving a compressed refrigerant discharged from the compression chambers P and the discharge passage 101*c*. The discharge chamber 116 communicates with an oil separating chamber 119, via a short passage 118 formed in the rear housing 103.

An oil storing chamber 117 is formed in both the fixed scroll element 101 and the rear housing 103 which is arranged to receive an oil separated from the compressed refrigerant within the above-mentioned oil separating chamber 119 via an oil passage 120 formed in a bottom portion of the oil separating chamber 119.

Figure 5:
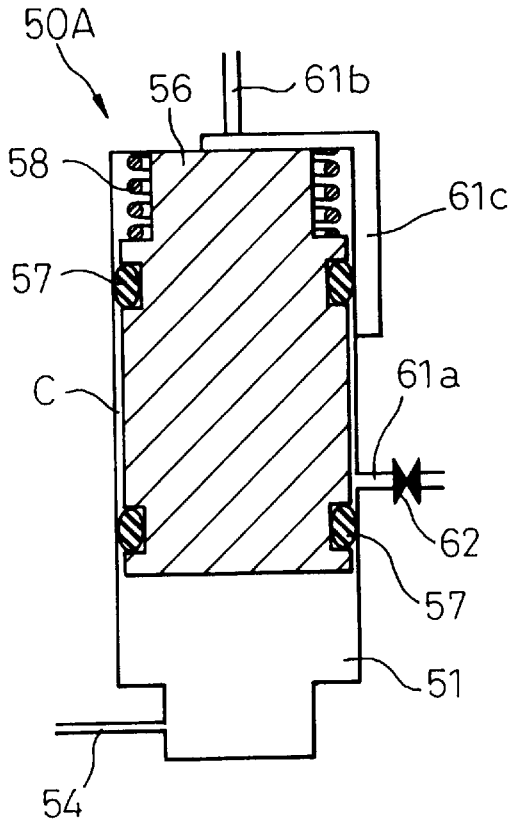
FIG. 5 is an enlarged cross-sectional view of a different valve assembly adapted for use in the oil-separating and lubricating system of the compressor of FIG. 4, illustrating a state where a valve port is opened by a valve element; and, FIG. 6 is a similar view to FIG. 5, illustrating a state where the valve port is closed by the valve element.
Figure 6:
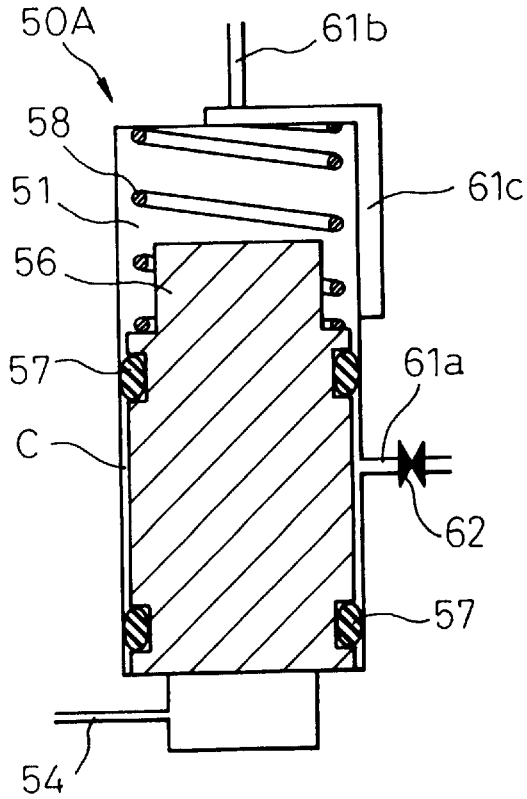

A pressure-operated valve 50A is assembled in a portion of the fixed side plate 101*a* of the fixed scroll element 101 in a posture reverse to that of the pressure-operated valve 50 of the reciprocating type refrigerant compressor of FIG. 1. As will be understood from the illustration of FIGS. 5 and 6, the function of the pressure-operated valve 50A is substantially the same as that of the valve assembly 50 of the previous embodiment. The pressure-operated valve 50A is different from the valve 50 only in that the downstream side oil passage 61*b* is arranged to extend from a low pressure region (a suction pressure region of the scroll type compressor) to one end of the valve chamber 51, i.e., an upper end of the valve chamber 51, and the downstream side oil passage 61*b* also functions as a pressure introducing passage to introduce a suction pressure "Ps" into the upper end of the valve chamber 51 of the pressure-operated valve 50A. An additional oil passage 61*c* formed in the rear housing 103 is arranged to communicate the upstream side oil passage 61*a* with the downstream side oil passage 61*b* when the valve spool is moved to the upper end of the valve chamber 51, as shown in FIG. 4.

The other end of the valve chamber 51, i.e., the lower end of the valve chamber 51 is fluidly connected to one of the compression chambers "P" by the pressure-introducing passage 54 which introduces a pressure corresponding to an intermediate pressure between the suction pressure "Ps" and the highest discharge pressure "Pd" into the lower end of the valve chamber 51. The upstream side oil passage 61*a* extending from the oil-storing chamber 117 is connected to the oil passage (the small gap around the valve spool 56) "C". The above-mentioned downstream side oil passage 61*b* extends from the upper end of the valve chamber 51 to a predetermined portion of the suction pressure region (a low pressure region) where a part of the movable side plate 109*a* is slidably engaged with an outermost end portion of the fixed spiral element 101*b*.

Therefore, when the scroll type refrigerant compressor is driven to move the movable scroll element 109 with respect to the fixed scroll element 101, so that each of the compression chambers P is spirally displaced from an initial position to a final position while compressing the refrigerant, the compressed refrigerant is successively discharged from each of the compression chambers P to the discharge chamber 116 via the discharge passage 101*c* and the discharge valve 114. The compressed refrigerant moves further from the discharge chamber 116 and into the oil separating chamber 119 via the short passage 118, so that the compressed refrigerant is spirally rotated along the cylindrical inner wall of the oil separating chamber 119 and around an oil-separating cylinder 121 fixed to an outer portion of the rear housing 103.

Thus, the compressed refrigerant is finally delivered from a delivery port formed in the oil-separating cylinder 121 toward the external refrigerating system. During the rotation of the compressed refrigerant around the oil-separating cylinder 121, an oil component suspended in the refrigerant in the gas-phase is separated therefrom due to a centrifugal force. Thus, the compressed refrigerant can be delivered into the external refrigerating system after the amount of oil contained in a unit weight of compressed refrigerant is sufficiently reduced to prevent heat exchanging units in the refrigerating system such as a condenser and an evaporator from being adversely affected by the oil component contained in the refrigerant from the viewpoint of thermal exchange.

During the operation of the scroll type refrigerant compressor, a pressure introducing into one of the opposite ends, i.e., the lower end of the valve chamber 51 of the pressure-operated valve 50A from the compression chamber P via the pressure-introducing passage 54 is very high and, accordingly, the high pressure urges the valve spool 56 toward the other end of the valve chamber 51, i.e., the uppermost end of the valve chamber 51 against a combined force of a low pressure introduced into the upper end of the valve chamber 51 from the suction pressure region via the downstream side oil passage 61*b* and the elastic restoring force of the spring element 58 so as to keep the pressure-operated valve 50A open. Therefore, the oil is supplied from the oil storing chamber 117 to the above-mentioned slidably engaging portions of the fixed spiral portion 101*b* and the movable side plate 109*a*, which are in the suction pressure region of the compressor, to lubricate these portions.

It should be understood that the intermediate pressure introduced from the compression chamber P can be very stable due to a specific operation characteristic performance peculiar to the rotary type refrigerant compressor.

When the scroll type compressor is stopped, the pressure introduced from the compression chamber P and prevailing in the lower end of the valve chamber 1 is reduced to a low pressure substantially equal to the suction pressure "Ps" of the compressor. Thus, the valve spool 56 is moved to the lower end of the valve chamber 51 so that the oil passage "C" around the valve spool 56 is fluidly disconnected from the additional oil passage 61*c* and accordingly, the pressure-operated valve 50A is quickly closed to fluidly disconnect the downstream side oil passage 61*b* from the upstream side oil passage 61*a*. Therefore, no oil is supplied from the oil-storing chamber 117 to the slidably engaging portion of the movable and fixed scroll elements 109 and 101. Accordingly, when the scroll type refrigerant compressor is started, oil compression does not occur.

From the foregoing description of the described preferred embodiments of the present invention, it will be understood that according to the present invention, a positive-displacement-type refrigerant compressor is provided with an oil storing chamber having a volume sufficient to store substantially the entire amount of the oil which can be circulated within the interior of the compressor and the oil suspended in the compressed refrigerant is separated from the refrigerant before the compressed refrigerant is delivered from the compressor to an external refrigerating system. Namely, the amount of oil contained in a unit weight of compressed refrigerant delivered from the compressor to the external refrigerating system is greatly reduced and accordingly, the heat exchanging efficiency in the external refrigerating system can be appreciably increased.

Further, as soon as the operation of the compressor is started due to the supply of a drive power from an external drive source, e.g., a vehicle engine, the circulation of the oil within the refrigerant compressor is immediately started, and therefore lubrication in the interior of the compressor can be achieved even at the starting time of the compressor. This fact means that the crank chamber of the compressor does not need to hold a specific amount of oil for the purpose of quickly lubricating the interior in the crank chamber at the start of the compressing operation of the compressor. Therefore, oil compression can be surely prevented when the operation of the compressor is started.

Further, since the pressure-operated valve incorporated in a positive-displacement-type refrigerant compressor employs a single movable element, i.e., a spring-biased valve spool to control the opening and closing of an oil passage from an oil storing chamber to a lubricated portion of the compressor, a simple construction and reliable operation of the valve can be ensured. Thus, an accurate control of the circulation of the oil within the refrigerant compressor can be guaranteed.

Finally, it should be understood that many and various changes and modifications will occur to a person skilled in the art without departing from the scope and spirit of the invention as claimed in the accompanying claims.

What we claim is:

1. A capacity type refrigerant compressor comprising:

a suction system to receive a refrigerant at a suction pressure from an external refrigerating system, a compressing mechanism having a compression chamber in which the refrigerant introduced from said suction system is compressed to discharge the refrigerant after compression into a discharge chamber, and an oil-separating and lubricating system for lubricating the interior of said capacity type refrigerant compressor by an oil separated from the refrigerant, wherein said oil-separating and lubricating system comprises:

an oil-separating unit accommodated in a high pressure region communicating with said discharge chamber to cause separation of the oil from the refrigerant after compression;

an oil-storing chamber accommodated in said high pressure region to store the oil separated by said oil-separating unit;

an oil-supply passage supplying the oil from said oil-storing chamber to said suction system;

a pressure-operated valve disposed in said oil-supply passage for regulating an amount of flow of the oil from said oil-storing chamber to said suction system in response to a change in a pressure differential between pressures prevailing in both said compression chamber and said suction system, said pressure-operated valve closing said oil-supply passage at a predetermined portion thereof when said compression mechanism stops its operation to compress the refrigerant.

2. A capacity type refrigerant compressor according to claim 1, wherein said pressure-operated valve comprises:

a valve chamber having opposite ends, one being fluidly communicating with said compression chamber and the other being fluidly communicating with said suction system, said valve chamber further having an inner wall provided with a first port constantly communicating with an upstream side of said oil-supply passage and a second port constantly communicating with a downstream side of said oil-supply passage;

a valve spool element arranged in said valve chamber to be movable between the opposite ends of said valve chamber, said valve spool element having opposite pressure receiving ends for receiving the pressure from said compression chamber and that from said suction system and an outer circumference extending between said opposite pressure receiving ends for defining a gap-like oil passage enclosed by said inner wall of said valve chamber and by a pair of sealing elements fitted around two predetermined spaced positions of said outer circumference of said valve spool element, said gap-like oil passage being arranged to provide a fluid communication between said upstream and downstream sides of said oil-supply passage;

an elastic element disposed in said valve chamber at said other of said opposite ends thereof to exhibit an elastic force constantly urging said valve spool element towards said one of said opposite ends of said valve chamber, so that when the pressure differential of said pressures from both said compression chamber and said suction system is overcome by the elastic force of said elastic element, said spool element being moved toward said one of said opposite ends of said valve chamber until the fluid communication between said upstream and downstream sides of said oil-supply passage is obstructed by said valve spool element.

3. A capacity type refrigerant compressor according to claim 1, wherein said oil-separating and lubricating system is provided with a flow restriction in a portion of said oil-supply passage.

4. A capacity type refrigerant compressor according to claim 3, wherein said flow restriction is provided in a downstream side of said oil-supplying passage with respect to said pressure-operated valve.

5. A capacity type refrigerant compressor according to claim 3, wherein said flow restriction is provided in an upstream side of said oil-supplying passage with respect to said pressure-operated valve.

6. A capacity type refrigerant compressor according to claim 2, wherein said pair of sealing elements comprise a pair of o-rings received in two annular recesses formed in said outer circumference of said valve spool element.

7. A capacity type refrigerant compressor according to claim 1, wherein when said compressing mechanism of said capacity type refrigerant compressor employs reciprocating pistons to compress the refrigerant, said pressure introduced from said compression chamber into said one of said opposite ends of said valve chamber and acting on said valve spool element is maintained substantially at an average of the pressures prevailing in said compression chamber by a restriction function provided by a passage introducing said pressure from said compression chamber.

8. A capacity type refrigerant compressor according to claim 1, wherein when said capacity type refrigerant compressor is a rotary type refrigerant compressor, said pressure introduced from said compression chamber into said one of said opposite ends of said valve chamber and acting on said valve spool element is maintained substantially at an intermediate value of the pressures prevailing in said compression chamber.

* * * * *